US006450765B1

(12) United States Patent
Carroll et al.

(10) Patent No.: US 6,450,765 B1
(45) Date of Patent: Sep. 17, 2002

(54) SEALING SYSTEM FOR A CENTRIFUGAL FAN

(75) Inventors: Jim K. Carroll, Peoria; Delbert L. Kramer, Metamora, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/597,367

(22) Filed: Jun. 19, 2000

(51) Int. Cl.[7] ..... F04D 29/16
(52) U.S. Cl. ..... 415/172.1; 415/173.1
(58) Field of Search ..... 415/170.1, 172.1, 415/173.1

(56) References Cited

U.S. PATENT DOCUMENTS

| | | | | |
|---|---|---|---|---|
| 3,245,656 A | * | 4/1966 | Desbaillets et al. | 415/112 |
| 4,066,047 A | | 1/1978 | Vidakovic et al. | |
| 4,210,833 A | | 7/1980 | Neveux | |
| 4,432,694 A | * | 2/1984 | Kuroda et al. | 415/172.1 |
| 4,836,148 A | | 6/1989 | Savage et al. | |
| 5,352,089 A | * | 10/1994 | Tokunaga et al. | 415/172.1 |
| 5,551,838 A | * | 9/1996 | Hugbart | 415/206 |
| 5,613,845 A | * | 3/1997 | Moon | 415/170.1 |
| 5,709,175 A | | 1/1998 | Carroll | |
| 5,845,612 A | | 12/1998 | Lakerdas et al. | |

FOREIGN PATENT DOCUMENTS

EP 0 296 447 B1 6/1988

OTHER PUBLICATIONS

W. Zobel et al., Radial fan & externally controlled viscous clutch for radial truck cooling system CCS, Filderstadt, Germany.

* cited by examiner

*Primary Examiner*—John Kwon
(74) *Attorney, Agent, or Firm*—Howard & Howard

(57) ABSTRACT

A fan assembly with an improved seal for a mobile machine cooling system is disclosed. A housing is mounted to a machine structure and an impeller is mounted for rotation with respect to the housing. The impeller includes a plurality of rotating blades supported on a flange. A fan inlet is mounted with the housing and directs air toward the blades. A rotating shroud extends outwardly from the impeller flange and has a shroud inlet that extends into the fan inlet to form a seal between the fan inlet and the shroud inlet. The method and apparatus includes forming the seal between the fan inlet and the rotating shroud to prevent leakage as the rotating blades generate a centrifugal airflow for discharge through a fan outlet.

24 Claims, 4 Drawing Sheets

Fig. 1c.
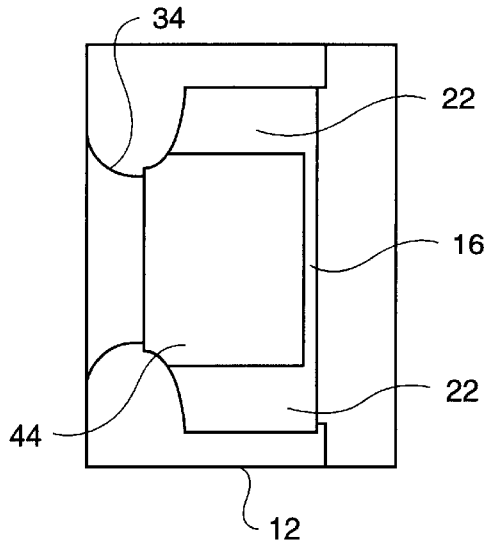
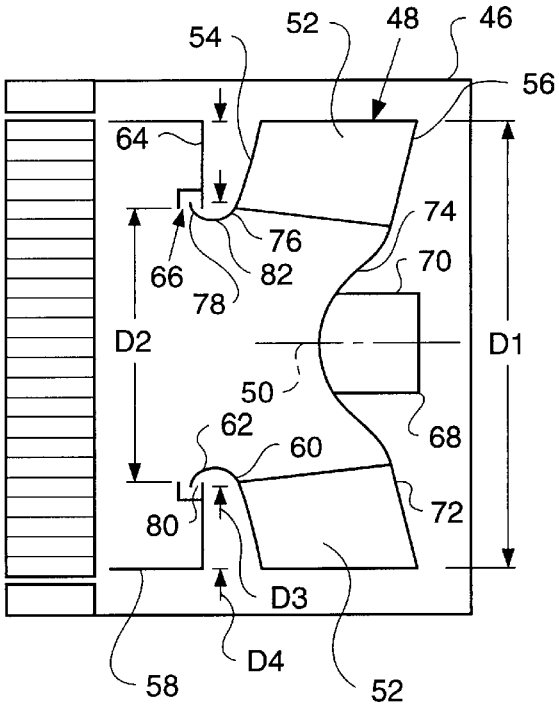
Fig. 2.

SEALING SYSTEM FOR A CENTRIFUGAL FAN

TECHNICAL FIELD

This invention relates generally to an improved seal assembly for a centrifugal fan and more particularly to a fan with a rotating shroud that extends into a fan inlet to create a labyrinth seal.

BACKGROUND ART

Centrifugal fans draw air in centrally and discharge air radially. The fans can be used to provide a cooling flow for various mobile machine systems, including a heat exchanger, for example. Centrifugal fans typically have a housing and an impeller with a plurality of rotating blades that are used to generate the centrifugal airflow. A fan inlet with a fixed inlet shroud is used to direct air toward the center of the rotating blades.

In known centrifugal fans, the fan inlet is mounted to the housing and remains stationary as the impeller rotates. The performance of the fan is strongly impacted by the ability to seal the area between the impeller and the fan inlet shroud. The impeller draws air through the fan inlet and adds energy to the airflow by accelerating the flow to a high velocity. Thus, the air inside the housing is at a higher pressure than the air in the inlet. The performance of the sealing arrangement between the inlet and the impeller determines how much of the high-pressure discharge air will be drawn into the inlet. Leaks at the sealing area between the inlet and the impeller are detrimental because leakage reduces the output flow of the fan.

Low inlet clearances between the inlet and the rotating impeller are critical to high efficiency and low noise. These tight clearances can be provided at the blade tips by a low clearance, fixed, contoured inlet shroud, as discussed above. Optionally, the tight clearances can be provided by having a rotating shroud with an axially extending inlet ring coupled to a low clearance, fixed, inlet bellmouth. For mobile machine applications, either design allows recirculation near the rotating blades, which requires very low sealing clearances. This is costly and difficult to maintain on mobile machines, which are subject to high vibrations and shock loads.

The present invention is directed to overcoming one or more of the problems as set forth above.

DISCLOSURE OF THE INVENTION

One aspect of the invention is a fan assembly for a machine cooling system. The fan includes a housing mounted to a machine structure and an impeller that is mounted for rotation with respect to the housing about a fan axis. The impeller includes a plurality of rotating blades supported on at least one impeller flange. A fan inlet is mounted within the housing for directing air toward the blades. A rotating shroud extends outwardly from the impeller flange and has a shroud inlet that extends into the fan inlet to form a seal between the fan inlet and the shroud inlet. The seal prevents leakage as the rotating blades generate a centrifugal airflow for discharge through a fan outlet.

Another aspect of the invention is that it includes a method for sealing a rotating fan impeller having a plurality of rotating blades supported on an impeller flange to a stationary fan inlet. The method includes the steps of mounting the fan inlet to a machine structure, mounting the impeller for rotation with respect to the fan inlet, extending a rotating shroud outwardly from the impeller flange to define a shroud inlet that extends into the fan inlet, and forming a seal between the fan inlet and the shroud inlet to prevent leakage as the rotating blades generate a centrifugal airflow for discharge through a fan outlet.

BRIEF DESCRIPTION OF THE DRAWINGS

For a better understanding of the present invention, reference may be made to the accompanying drawings in which:

FIG. 1C is a cross-sectional view of the fan assembly shown in FIG. 1B;

FIG. 2 is a cross-sectional view of a centrifugal fan incorporating the inventive rotating shroud seal assembly;

BEST MODE FOR CARRYING OUT THE INVENTION

Figure 1A:
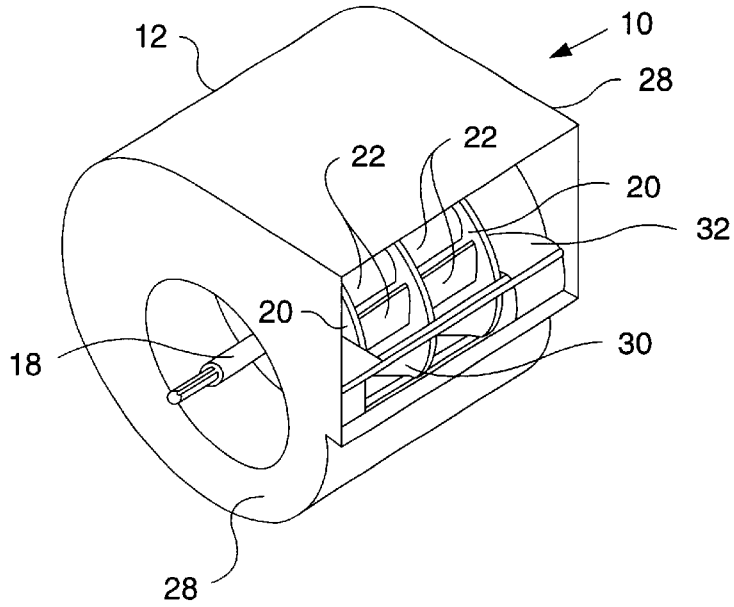
FIG. 1A is a perspective view of a centrifugal fan assembly with two (2) impellers.
Figure 1B:
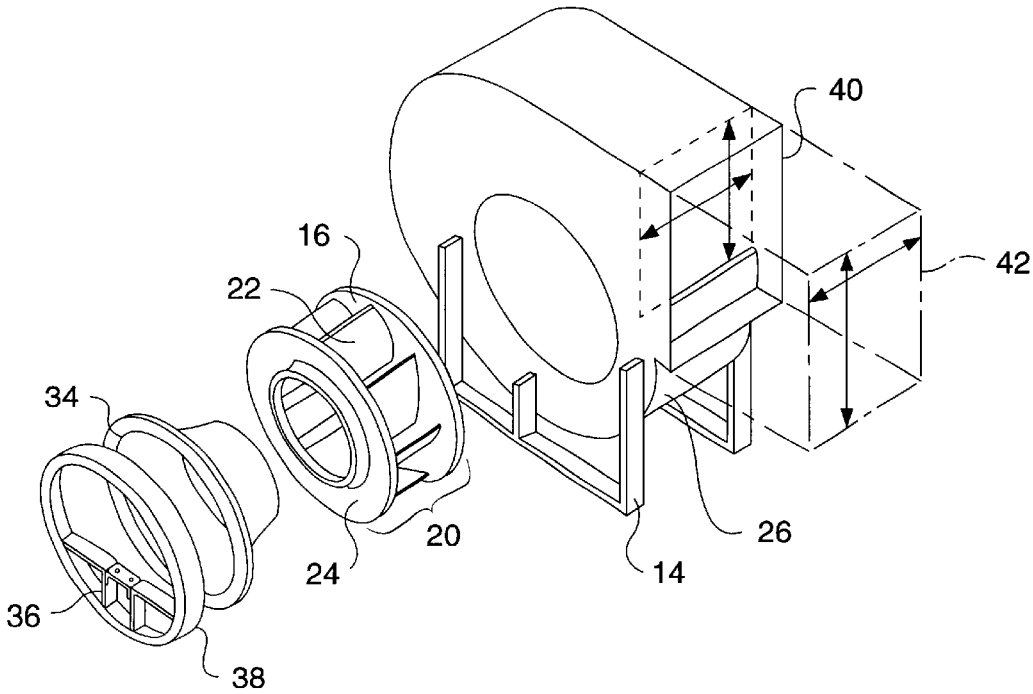
FIG. 1B is an exploded view, partially cut-away to show only one impeller, of the fan assembly shown in FIG. 1.

Referring now to the drawings, and initially to FIGS. 1A–1C, a known centrifugal fan assembly 10 for a machine cooling system is shown. Prior to this invention, centrifugal fans draw air in centrally and discharge air radially. The fans can be used to provide a cooling flow for a machine cooling system, such as a heat exchanger (not shown), for example.

The fan assembly includes a housing 12 that is mounted to a machine structure 14 such as a machine frame member, for example. A shaft 18 is rotatably supported with respect to the housing 12 and an impeller 20 is fixed for rotation with the shaft 18. The impeller 20 includes a plurality of rotating blades 22 that are supported between a first impeller flange 24 and a second impeller flange 16.

As shown in FIG. 1A, the housing 12 includes a central body or scroll portion 26 with a pair of side sheets 28. A pair of impellers 20 are mounted within the scroll portion 26 on the shaft 18. The impellers 20 are separated by a center plate 30.

The fan assembly 10 also includes a central diverter plate 32 that directs airflow. Air is drawn into the housing 12 via a fan inlet 34, shown in FIG. 1B. In known centrifugal fans, the fan inlet 34 is mounted to the fan housing 12 and the impeller 20 is rotatably supported on a bearing support 36, which has an inlet collar 38.

The air is directed toward the center of the rotating blades 22 via the inlet 34. The rotating blades 22 generate a centrifugal airflow and discharge air through a fan outlet 40. The fan outlet 40 is defined by an outlet area 42 that must be large enough to provide sufficient cooling air for the machine system.

As shown in FIG. 1C, the fan inlet 34 is mounted to the housing 12 and remains stationary as the impeller 20 rotates. The performance of the fan 10 is strongly impacted by the ability to seal the area between the impeller 20 and the fan inlet 34. The impeller 20 draws air through the fan inlet 34 and adds energy to the airflow by accelerating the flow to a high velocity. Thus, the air inside the housing 12 is at a higher pressure than the air in the inlet 34. The performance of the sealing arrangement between the inlet 34 and the impeller 20 determines how much of the high-pressure discharge air will be drawn into the inlet 34. Leaks at the sealing area between the fan inlet 34 and the impeller 20 are detrimental because leakage reduces the output flow of the fan 10. The leak path is shown at 44 in FIG. 1C.

Although the preferred embodiment shown in FIGS. 1A–C show a volute type outlet structure, a box type outlet having 2, 3 or 4 sides open, or other geometric shaped outlet could also be used.

These known centrifugal fans depend upon the ability to maintain tight clearances between the inlet 34 and the impeller 20 to minimize leakage within the fan. Tight clearances are difficult to maintain on mobile machines, which are subject to high vibrations and shock loads. With such tight clearances, fan components can come into contact with each other as the machine operates, causing pre-mature component wear and component failure.

Figure 3:
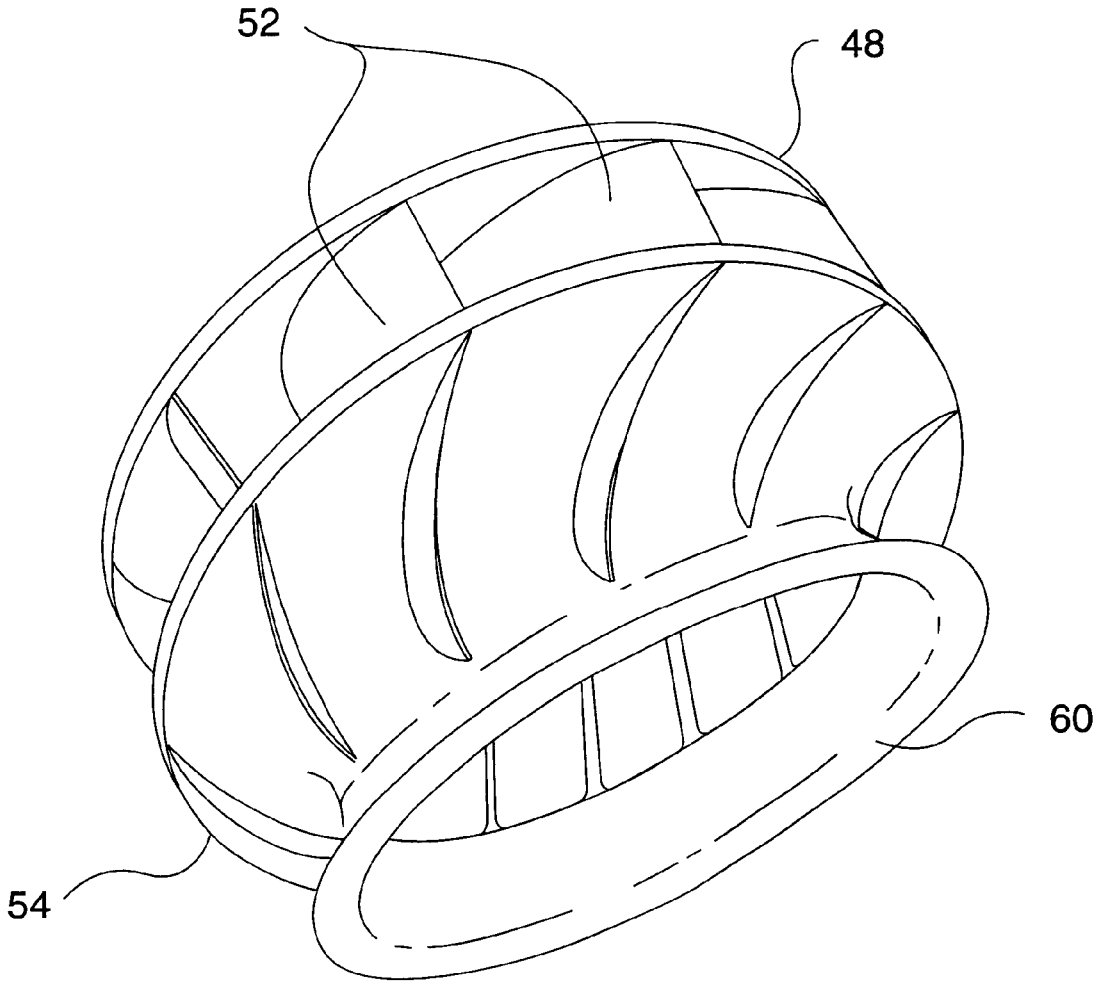
FIG. 3 is perspective view of the impeller and rotating shroud assembly.

A solution to these problems is shown in FIGS. 2–3. The fan assembly for a machine cooling system includes a housing 46 mounted to a machine structure 14 and an impeller 48 mounted for rotation with respect to the housing 46 about a fan axis 50. The impeller 48 has a plurality of rotating blades 52 supported on at least one impeller flange 54. Preferably, the blades are supported between a first impeller flange 54 and a second impeller flange 56 that is spaced axially apart from the first impeller flange 54 relative to the fan axis 50. The blades 52 are connected to the first 54 and second 56 impeller flanges on opposing edges.

A fan inlet 58 is mounted within the housing 46 for directing air toward the blades 52. A rotating shroud 60 extends outwardly from the impeller flange 54 and has a shroud inlet portion 62 extending into the fan inlet 58 to form a seal 66 between the fan inlet 58 and the shroud inlet 62. The seal 66 prevents leakage as the rotating blades 52 generate a centrifugal airflow for discharge through the fan outlet 40. The shroud 60 is preferably formed as one piece with the impeller flange 54.

The blades 52 are defined by a maximum blade diameter D1 and the shroud inlet 62 is defined by a maximum shroud inlet diameter D2. The blade diameter D1 is preferably greater than the shroud inlet diameter D2. The fan inlet 58 includes an inwardly extending inlet flange 64 having an inner diameter D3 and an outer dimension D4. The outer dimension D4 may define a square, circle or other geometric shape. The inner diameter D3 is preferably less than the shroud inlet diameter D2, such that in the preferred embodiment, the seal 66 is formed as a dual labyrinth or "U" seal between the inlet flange 64 and the shroud inlet 62.

Figure 4:
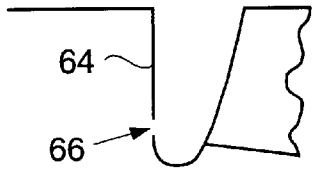
FIG. 4 is a cross-sectional view of a radial clearance seal configuration.
Figure 5A:
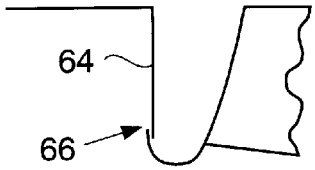
FIG. 5A is a cross-sectional view of a first overlapping seal configuration.
Figure 5B:
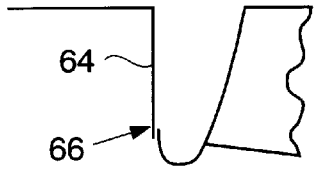
FIG. 5B is a cross-sectional view of a second overlapping seal configuration.
Figure 6A:
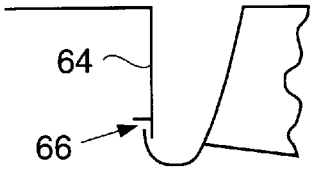
FIG. 6A is a cross-sectional view of a first labyrinth or "L" seal configuration.
Figure 6B:
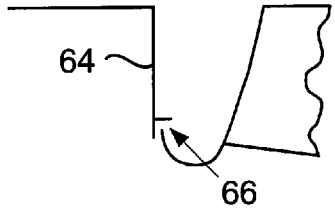
FIG. 6B is a cross-sectional view of a second labyrinth or "L" seal configuration.
Figure 7A:
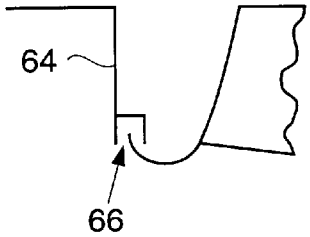
FIG. 7A is a cross-sectional view of a first alternative dual labyrinth or "U" seal configuration.
Figure 7B:
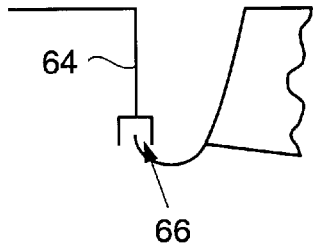
FIG. 7B is a cross-sectional view of a second alternative dual labyrinth or "U" seal configuration.

Although the seal 66 in the preferred embodiment described above and shown in FIG. 2 is shown as a dual labyrinth or "U" seal, other types of seal configurations such as shown in, but not limited to, FIGS. 4 Radial Clearance Seal, 5A first Overlapping Seal, 5B second Overlapping Seal, 6A first Labyrinth or "L" Seal, 6B second Labyrinth or "L" Seal, 7A first alternative Dual Labyrinth or "U" Seal, or 7B second alternative Dual Labyrinth or "U" Seal could also be used.

The impeller 48 includes a centrally located hub 68 for supporting a drive motor 70. The drive motor 70 is preferably a hydraulic drive motor that is mounted within the cone-shaped hub 68. However, an electric drive motor could also be used in place of the hydraulic drive motor. As discussed above, the first impeller flange 54 is connected to the shroud 60 and the second impeller flange 56 has a curved exterior surface 72 extending inwardly toward the hub 68, at an angle with respect to the fan axis 50, to form a central pocket 74. The drive motor 70 is mounted within the central pocket 74. This provides a more compact fan design that requires significantly less packaging space than known fan designs.

The rotating shroud 60 is preferably U-shaped with a first portion 76 extending outwardly away from the fan axis 50 and into the impeller flange 54 such that the impeller flange 54 and the first portion 76 are integrally formed as one piece. A second portion 78 of the rotating shroud 60 extends outwardly away from the fan axis 50 and into the fan inlet 58 to define a clearance gap 80 between the inlet flange 64 and the second portion 78. A center base portion 82 interconnects the first 76 and second 78 portions to form the "U" shape.

A method for sealing the rotating fan impeller 48 having a plurality of rotating blades 52 supported on an impeller flange 54 to a stationary fan inlet 58 includes the following steps. Mounting the fan inlet 58 to a machine structure 14. Mounting the impeller 48 for rotation with respect to the fan inlet 58. Extending the rotating shroud 60 outwardly from the impeller flange 54 to define a shroud inlet 62 that extends into the fan inlet 58. Forming a seal 66 between the fan inlet 58 and the shroud inlet 62 to prevent leakage as the rotating blades 52 generate a centrifugal airflow for discharge through the fan outlet 40.

Additional steps include providing the fan inlet 58 with an inwardly extending inlet flange 64 and forming the seal 66 as a dual labyrinth or "U" seal between the inlet flange 64 and the shroud inlet 62.

Although forming the seal 66 in the preferred embodiment described above and shown in FIG. 2 is described as a dual labyrinth or "U" seal, other types of seal configurations such as shown in, but not limited to, FIGS. 4 Radial Clearance Seal, 5A first Overlapping Seal, 5B second Overlapping Seal, 6A first Labyrinth or "L" Seal, 6B second Labyrinth or "L" Seal, 7A first alternative Dual Labyrinth or "U" Seal, or 7B second alternative Dual Labyrinth or "U" Seal could also be used.

Other steps include defining the blades 52 by a maximum blade diameter D1 and defining the shroud inlet 62 by a shroud inlet diameter D2 that is less than the blade diameter D1. The fan inlet flange 64 has an inner diameter D3 and an outer dimension D4 where the inner diameter D3 is less than the shroud inlet diameter D2 and the outer dimension D4 defines a square, circle or other geometric shape.

The blades 52 preferably have an inclined leading edge. This blade configuration increases the overall strength of the fan assembly. The combination of the inclined leading edge and the U-shaped rotating shroud 60 result in high dynamic stiffness and natural frequency of vibration. This improves durability for vibration and shock requirements for a mobile machine application.

The material for the impeller 46 and rotating shroud 60 is preferably a high strength to weight ratio material such as T6-treated aluminum or a glass re-enforced, non-metallic material, for example.

A preferred manufacturing method for the impeller 48 and rotating shroud 60 is carried out using a low pressure injection sand casting of aluminum as the prime path. Melting core technology, nylon molding, laser fabrication, composite molding, and injection molding/hot plate welding are other manufacturing method alternatives.

INDUSTRIAL APPLICABILITY

The inventive fan assembly and sealing method for a centrifugal fan eliminates the need to maintain tight clearances between a fan inlet member and an impeller and allows lighter fan components to be used. The fan is a compact design that is high strength and light-weight with a compact design and improved durability. The fan can be made using low cost manufacturing methods and has a robust installation design. The following description is only for the purposes of illustration and is not intended to limit the present invention as such. It will be recognizable, by those skilled in the art, that the present invention is suitable for a plurality of other applications.

The present invention uses a U-shaped rotating shroud mounted to a fan impeller flange to provide a seal between the impeller and the fan inlet. The rotating shroud extends into the fan inlet to form the seal. The seal can be used with centrifugal fans that utilize one or more impellers mounted within the housing. The seal between the rotating shroud and fan inlet is formed as a dual labyrinth seal that maintains high fan efficiency and low noise.

Other aspects, objects and advantages of this invention can be obtained from a study of the drawings, the disclosure and the appended claims.

What is claimed is:

1. A fan assembly for a machine cooling system comprising:

a housing mounted to a machine structure;

an impeller mounted for rotation with respect to said housing about a fan axis and including a plurality of rotating blades supported on at least one impeller flange;

a fan inlet mounted within said housing for directing air toward said blades; and a rotating shroud extending outwardly from said impeller flange away from the fan axis and having a shroud inlet extending axially into said fan inlet to form a seal between said fan inlet and said shroud inlet to prevent leakage as said rotating blades generate a centrifugal airflow for discharge through a fan outlet.

2. The assembly of claim 1, wherein said blades are defined by a maximum blade diameter and said shroud inlet is defined by a maximum shroud inlet diameter, said blade diameter being greater than said shroud inlet diameter.

3. The assembly of claim 2, wherein said fan inlet includes an inwardly,extending inlet flange having an inner diameter and an outer dimension, said inner diameter being less than said shroud inlet diameter.

4. The assembly of claim 3, wherein said seal is formed as a dual labyrinth seal between said inlet flange and said shroud inlet.

5. The assembly of claim 3, wherein said inlet flange forms an opening for receiving said shroud inlet.

6. The assembly of claim 3, wherein said seal is formed as an overlapping seal between said inlet flange and said shroud inlet.

7. The assembly of claim 3, wherein said seal is formed as a labyrinth seal between said inlet flange and said shroud inlet.

8. The assembly of claim 1, wherein said shroud is formed as one piece with said impeller flange.

9. The assembly of claim 1, wherein said blades have an inclined leading edge.

10. The assembly of claim 1, wherein said impeller includes a centrally located hub for supporting a drive motor.

11. The assembly of claim 10, wherein said at least one impeller flange is comprised of a first impeller flange and a second impeller flange spaced axially apart from said first impeller flange relative to said fan axis, said blades being connected to said first and second impeller flanges on opposing edges.

12. The assembly of claim 11, wherein said first impeller flange is connected to said shroud and said second impeller flange has a curved exterior surface extending inwardly toward said hub to form a central pocket.

13. The assembly of claim 12, wherein said drive motor is mounted within said central pocket.

14. A method for sealing a rotating fan impeller including a plurality of rotating blades supported for rotation about a fan axis on an impeller flange to a stationary fan inlet comprising the steps of:

mounting the fan inlet to a machine structure;

mounting the impeller for rotation with respect to the fan inlet;

extending a rotating shroud outwardly from the impeller flange away from the axis to define a shroud inlet that extends axially into the fan inlet; and forming a seal between the fan inlet and the shroud inlet to prevent leakage as the rotating blades generate a centrifugal airflow for discharge through a fan outlet.

15. The method of claim 14, including the steps of providing the fan inlet with an inwardly extending inlet flange; and forming the seal as a dual labyrinth seal between the inlet flange and the shroud inlet.

16. The method of claim 14, including the steps of providing the fan inlet with an inwardly extending inlet flange defining an opening, the shroud inlet extending axially into the said opening.

17. The method of claim 14, including the steps of providing the fan inlet with an inwardly extending inlet flange; and forming the seal as an overlapping seal between the inlet flange and the shroud inlet.

18. The method of claim 14, including the steps of providing the fan inlet with an inwardly extending inlet flange; and forming the seal as a labyrinth seal between the inlet flange and the shroud inlet.

19. The method of claim 14, including the step of forming the shroud and the impeller flange as one piece.

20. The method of claim 14, including the steps of defining the blades by a maximum blade diameter and defining the shroud inlet by a shroud inlet diameter that is less than the blade diameter.

21. The method of claim 20, including the steps of providing the fan inlet with an inwardly extending inlet flange having an inner diameter and an outer dimension, and defining the inner diameter to be less than the shroud inlet diameter.

22. A fan assembly for a machine cooling system comprising:

a housing mounted to a machine structure;

an impeller mounted for rotation about a fan axis with respect to said housing and including a plurality of rotating blades supported on an impeller flange, said blades being defined by a maximum blade diameter;

a fan inlet mounted within said housing for directing air toward said blades and having an inwardly extending inlet flange with an inner diameter defining an opening and an outer dimension; and a rotating shroud extending outwardly from said impeller flange and having a shroud inlet defined by a maximum shroud inlet diameter, said shroud inlet extending axially into the opening defined by said fan inlet to form a seal between said fan inlet and said shroud inlet to prevent leakage as said rotating blades generate a centrifugal airflow for discharge through a fan outlet.

23. The assembly of claim 22, wherein said blade diameter is greater than said shroud inlet diameter and said inner diameter is less than said shroud inlet diameter.

24. The assembly of claim 23, wherein said shroud is U-shaped with a first portion extending outwardly away from said fan axis and into said impeller flange such that said impeller flange and said first portion are integrally formed as one piece, a second portion extending outwardly away from said fan axis and into said fan inlet to define a clearance gap between said inlet flange and said second portion, and a center base portion for interconnecting said first and second portions.

* * * * *